United States Patent [19]

Wang et al.

[11] Patent Number: 4,532,031

[45] **Date of Patent: * Jul. 30, 1985**

[54] FROTH FLOTATION PROCESS

[75] Inventors: Samuel S. Wang, Cheshire; Michael J. Scanlon, Stratford, both of Conn.

[73] Assignee: American Cyanamid Company, Stamford, Conn.

[ * ] Notice: The portion of the term of this patent subsequent to Jul. 19, 2000 has been disclaimed.

[21] Appl. No.: 487,363

[22] Filed: Apr. 21, 1983

Related U.S. Application Data

[60] Division of Ser. No. 390,574, Jun. 21, 1982, Pat. No. 4,394,257, which is a continuation of Ser. No. 95,839, Nov. 19, 1979, abandoned.

[51] Int. Cl.[3] ..... B03D 1/14

[52] U.S. Cl. ..... 209/166; 252/61; 560/17; 560/147

[58] Field of Search ..... 560/147, 152, 17; 209/166, 167; 252/61

[56] References Cited

U.S. PATENT DOCUMENTS

| | | | |
|---|---|---|---|
| Re. 22,117 | 6/1942 | Janney et al. | 209/166 |
| 2,011,176 | 8/1935 | Keller | 209/166 |
| 2,199,799 | 5/1940 | Jacobson | 560/17 |
| 2,416,052 | 2/1947 | Gribbins | 560/152 |
| 2,657,800 | 11/1953 | Hall | 209/166 |
| 3,301,400 | 1/1967 | Bikales | 209/166 |
| 3,785,488 | 1/1974 | Werneke | 209/167 |
| 4,136,020 | 1/1979 | Fischer | 252/61 |
| 4,185,155 | 1/1980 | Bader et al. | 560/152 |
| 4,274,950 | 6/1981 | Larribau et al. | 209/166 |
| 4,394,257 | 7/1983 | Wang et al. | 209/166 |

FOREIGN PATENT DOCUMENTS

| | | | |
|---|---|---|---|
| 1355091 | 5/1974 | United Kingdom | 209/166 |
| 2067098 | 7/1981 | United Kingdom | 209/167 |

*Primary Examiner*—Bernard Nozick
*Attorney, Agent, or Firm*—John W. Cornell

[57] ABSTRACT

A process for the recovery of mineral values by froth flotation in an aqueous medium employing a novel frother. Frothers prepared by Michael addition between alpha, beta-unsaturated ethylenic compounds and either alcohols, amines or mercaptans or by the condensation of HCN, aldehydes/ketones with either alcohols, amines or mercaptans have been found to be effective in the froth flotation system and capable of reducing the required collector consumption.

4 Claims, No Drawings

FROTH FLOTATION PROCESS

This is a divisional of application Ser. No. 390,574, filed June 21, 1982 now U.S. Pat. No. 4,394,257 which is a continuation of Ser. No. 095,839 filed Nov. 19, 1979 now abandoned.

BACKGROUND OF THE INVENTION

Froth flotation is a commonly employed process for concentrating minerals from ores. In a flotation process, the ore is crushed and wet ground to obtain a pulp. A frothing agent, usually employed with a collecting agent, is added to the ore to assist in separating valuable minerals from the undesired or gangue portions of the ore in subsequent flotation steps. The pulp is then aerated to produce a froth at the surface thereof and the collector assists the frothing agent in separating the mineral values from the ore by causing the mineral values to adhere to the bubbles formed during this aeration step. The adherence of the mineral values is selectively accomplished so that the portion of the ore not containing mineral values does not adhere to the bubbles. The mineral-bearing froth is collected and further processed to obtain the desired minerals. That portion of the ore which is not carried over with the froth, usually identified as "flotation tailings", is usually not further processed for extraction of mineral values therefrom. The froth flotation process is applicable to ores containing metallic and non-metallic mineral values.

In flotation processes, it is desirable to recover as much mineral values as possible from the ore while effecting the recovery in a selective manner, that is, without carrying over undesirable portions of the ore in the froth.

While a large number of compounds have foam or froth producing properties, frothers widely used in commercial froth flotation operations include polyalkylene glycol compositions and alkyl ethers thereof (see, for example, U.S. Pat. Nos. 3,595,390; 2,611,485 and 2,695,101). The frothers most widely used in froth flotation operations are compounds containing a nonpolar, water-repellant group and a single, polar, water-avid group such as hydroxyl (OH). Typical of this class of frothers are mixed amyl alcohols, methylisobutyl carbonol (MIBC), hexyl and heptyl alcohols, cresols, terpinol, etc. Other effective frothers used commercially are the $C_1$–$C_4$ alkyl ethers of polypropylene glycol, especially the methyl ether and the polypropylene glycols of 140–2100 molecular weight and particularly those in the 400–1100 range. More recently, sulfide-containing polyalkylene oxide (U.S. Pat. No. 4,122,004) and mercaptan polyalkylene oxide (U.S. Pat. No. 4,130,477) have been found to be effective frothers as well.

Although mineral recovery improvements from a preferred frother in the treatment of an ore can be as low as only about 1 percent over other frothers, this small improvement is of great importance economically since commercial operations often handle as much as 50,000 tons of ore daily. With the high throughput rates normally encountered in commercial flotation processes, relatively small improvements in the rate of mineral recovery result in the recovery of additional tons of minerals daily. Obviously, any frother which promotes improved mineral recovery, even though small, is very desirable and can be advantageous in commercial flotation operations, especially in view of increasing energy costs.

Thus, there exists a continuing need for frothing agents which improve the selective recovery of mineral values from ores in the present flotation processes. Such improvements act not only to enhance the state of metallurgy, but can reduce the promoter consumption requirements of the mining industry as a whole.

SUMMARY OF THE INVENTION

The present invention provides for a process for collecting mineral values from an ore wherein said process comprises mixing ground ore with water to form an aqueous ore pulp, adding to said aqueous ore pulp an effective amount of a frother, aerating said aqueous ore pulp and thereafter recovering said mineral values. The frother of the instant process is of the general formula:

$$R-W-[\overset{\overset{X}{|}}{\underset{\underset{Y}{|}}{C}}]_n-Z$$

wherein R is taken from the group consisting of a saturated aliphatic radical of 1 to 12 carbon atoms, inclusive, a phenyl and an alkylaryl wherein the alkyl group consists of a saturated aliphatic radical of 1 to 6 carbon atoms, inclusive, W is taken from the group consisting of ooxygen, sulfur, imino and alkyl substituted imino wherein the alkyl radical consists of a saturated aliphatic radical of 1 to 12 carbon atoms, inclusive, n is an integer of 1 to 4 inclusive, X and Y are individually either hydrogen or a saturated aliphatic radical of 1 to 8 carbon atoms inclusive, and Z is taken from the group consisting of $$-\overset{\overset{O}{\|}}{C}-OR'',\ -C\equiv N,\ -\overset{\overset{O}{\|}}{C}-NH_2 \text{ and } -O-R'''$$

wherein R'' and R''' are aliphatic radis having 1 to 8 carbon atoms, inclusive.

DETAILED DESCRIPTION OF THE INVENTION

In accordance with the present invention there is provided a process for collecting mineral values from an ore. The process of the present invention is useful in the recovery of mineral values from all ores that employ a frother in their processing, i.e. a frother in the froth flotation stage of their mineral value recovery. These ores include, but are not limited to, the sulfide ores, the oxide ores and also coal and talc.

The process entails initially mixing the ground ore with water to form an aqueous ore pulp. The aqueous ore pulp is then conditioned with an effective amount of the frother of the present invention. An effective amount is that amount of frother sufficient to obtain the recovery level desired for the ore system being treated. Although this amount will vary depending upon the ore being treated, the other additives within the system and variables of a similar nature, it has generally been found that from about 0.01 pounds of frother per ton of ore to about 1.0 pounds of frother per ton of ore is effective, preferably, 0.02 to 0.5 pounds per ton. Other additives that are mixed with the aqueous ore pulp at this stage in the process may include promoters, dispersants, pH modifiers, depressants and the like. After the aqueous ore pulp has been conditioned sufficiently long enough, the pulp is aerated to produce the froth or foam and the mineral values are collected out of the flotation system in this froth or foam.

The frother employed in the instant invention is conveniently prepared by the Michael addition of alpha,-beta unsaturated ethylenic compounds or other unsaturated nitriles with either alcohols, amines or mercaptans in the presence of a catalyst such as potassium hydroxide, sodium hydroxide, trimethylbenzylammonium hydroxide and the like. The reaction temperature is in the range of 10° to 175° C., preferably 30°-80° C. The reaction pressure will depend upon the temperature of the reaction, volume of the autoclave and quantity of reactants. The duration of reaction is from one to four hours. For a more detailed description on the Michael addition of alpha,beta-unsaturated ethylenic compounds with alcohols see U.S. Pat. Nos. 2,280,791 and 2,280,792, issued to Bruson; with amines see Journal of the American Chemical Society, Vol. 68, page 1217 (1946), and with mercaptan see U.S. Pat. No. 2,413,917, issued to Harmon. An alternative method of preparation is the condensation of HCN, aldehydes/Ketones with either alcohols, amines or mercaptans as is set forth in Journal of the American Chemical Society, Vol. 82, page 696 (1960).

With respect to the Michael addition, examples of suitable starting alcohols are methyl, ethyl, propyl, n-butyl, isobutyl, tert.butyl, pentyl, hexyl, octyl, nonyl, dodecyl, decyl, cyclohexyl, cyclopentyl, benzyl and phenyl and the like. Suitable starting amines include methyl, dimethyl, ethyl, diethyl, propyl, dipropyl, n-butyl isobutyl, tert.butyl, dibutyl, pentyl, dipentyl, hexyl octyl, nonyl, dodecyl, decyl, cyclohexyl, phenyl and the like. Suitable starting mercaptans include methyl, ethyl, propyl, isobutyl, n-butyl, tert.butyl, pentyl, hexyl, octyl, nonyl, dodecyl, decyl, cyclohexyl, benzyl, mercapto ethanol and the like. Suitable starting olephenic compounds include acrylonitrile, methyl methacrylate, methyl vinyl ether, ethyl vinyl ether, n,iso or tert.butyl vinyl ether, 2-methyl 2-butene nitrile, 2-methyl 3-butene nitrile, 2-pentene nitrile, 3-pentene nitrile and the like.

Examples of products derived from the Michael addition include, but are not limited to, 2-cyanoethyl, isobutyl sulfide; 2-cyanoethyl, hexyl sulfide; 2-cyanoethyl,cyclohexyl sulfide; 2-cyanoethyl, n-butyl ether; 2-cyanoethyl, octyl ether; 2-cyanoethyl, benzyl ether; 2-cyanoethyl,butyl amine; 2-cyanoethyl,dibutyl amine; 2-cyanoethyl,cyclohexyl amine; methyl,3-(isobutylthio)-2-methyl propionate; methyl,3-(pentylthio)-2-methyl propionate; methyl,3-(isobutoxy)-2-methyl propionate; methyl,3-(pentoxy)-2-methyl propionate; methyl-3(methylamino)-2-methyl propionate; methyl-3-(diisobutylamino)-2-methyl propionate; 2-(butylthio)ethyl,ethyl ether; 2-(benzylthio)ethyl, butyl ether; 2-(methoxy)ethyl,ethyl ether; 2-(butoxy)-ethyl,butyl ether; 2-(butylamino)ethyl, ethyl ether; 2-(benzylamino)ethyl,butyl ether and the like.

With respect to the condensation reaction, suitable starting materials include, but are not limited to, formaldehyde acetaldehyde, propionaldehyde, acetone, methyl ethyl ketone, ethyl ketone and the mercaptans, alcohols and amines set forth above. Examples of compounds formed from such a condensation reaction include, but are not limited to, 2-(cyanopropyl)methyl ether; 1-(cyanobutyl)methyl ether; 1-(cyanopropyl-)ethyl sulfide and 1-(cyanobutyl)methyl amine.

The following specific examples illustrate certain aspects of the present invention and, more particularly, point out methods of evaluating the unique advantages of employing the novel frothers in the froth flotation system. However, the examples are set forth for illustration only and are not to be construed as limitations on the present invention except as set forth in the appended claims. All parts and percentages are by weight unless otherwise specified.

EXPERIMENTAL PROCEDURE

A 500 part sample of copper-molybdenum ore is crushed to −10 mesh and thereafter further ground in a rod mill in the presence of 333 parts of water to the size indicated. To this ground ore pulp there is then added sufficient lime to adjust the pH to 9.0. Next, 0.015 pound per ton of ore of a sodium cyanide conditioner is added to the ground ore pulp and allowed to condition for 1 minute at about 1100 rpms. Finally, 0.034 pound of reconstituted cresylic acid per ton of ore is added as a promoter in conjunction with the frother. The mixture is allowed to condition for 1 minute. The pulp is then aerated and the concentrate collected for 7 minutes. The concentrate and tailings are assayed according to conventional techniques and the data tabulated.

PREPARATION OF CYANOETHYL ISOBUTYLSULFIDE

241 Parts of isobutyl mercaptan are charged into a suitable reaction vessel equipped with a condenser, stirrer, thermometer and graduated addition funnel. The initial charge is agitated as 5 parts of benzyltrimethylammonium hydroxide (40% in methanol) is added. Next, 143.4 parts of acrylonitrile are added dropwise at approxomately 0.85 ml/minute via the graduated addition funnel. The reaction commences during the addition of the acrylonitrile. The reaction temperature is maintained at about 40° C., ±5° C., for the duration of the addition, approximately 3½ hours. Since the reaction is exothermic, external cooling is required.

After addition is complete the reaction is continued until the exothermic reaction subsides and the temperature drops to approximately 25° C. Thereafter 5.9 parts of 10% sulfuric acid is charged to neutralize the base catalyst. The final charge is heated to 100° C. to distill off any unreacted materials, again cooled to ambient temperatures, filtered and a nearly quantitative yield is collected for use.

COMPARATIVE EXAMPLE A

The Experimental Procedure set forth above is followed in every material detail on an ore sample ground to 2.4% +100 mesh and 60.2% −200 mesh and employing 0.17 pound per ton of ore of a polypropylene glycol frother with a molecular weight of 425 of the general structure:

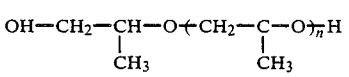

Test results are set forth in Table I below.

COMPARATIVE EXAMPLE B

The Experimental Procedure set forth above is followed in every material detail on an ore sample ground to 2.4% +100 mesh and 60.2% −200 mesh and employing 0.17 pound per ton of ore of a methyl isobutyl carbinol frother of the general structure:

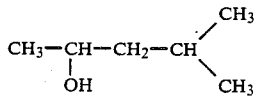

Tests results are set forth in Table I below.

COMPARATIVE EXAMPLE C

The Experimental Procedure set forth above is followed in every material detail on an ore sample ground to 2.4% +100 mesh and 60.2% −200 mesh and employing 0.17 pound per tone of ore of a butoxy propanol frother of the general structure:

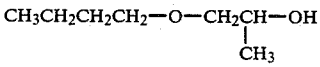

Test results are set forth in Table I below.

EXAMPLE 1

The Experimental Procedure set forth above is followed in every material detail on an ore sample ground to 2.4% +100 mesh and 60.2% −200 mesh and employing 0.17 pound per ton of ore of an isobutyl cyanoethyl amine frother of the general structure:

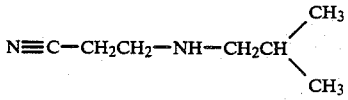

Tests results are set forth in Table I below.

EXAMPLE 2

The Experimental Procedure set forth above is followed in every material detail on an ore sample ground to 2.4% +100 mesh and 60.2% −200 mesh and employing 0.17 pound per ton of ore of an isobutyl cyanoethyl sulfide frother of the general structure:

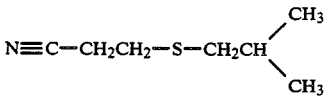

Test results are set forth in Table I below.

EXAMPLE 3

The Experimental Procedure set forth above is followed in every material detail on an ore sample ground to 2.4% +100 mesh and 60.2% −200 mesh and employing 0.17 pound per ton of ore of an isobutyl cyanoethyl ether frother of the general structure:

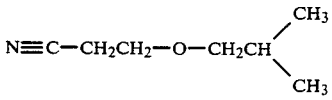

Test results are set forth in Table I below.

EXAMPLE 4

The Experimental Procedure set forth above is followed in every material detail on an ore sample ground to 2.4% +100 mesh and 60.2% −200 mesh and employing 0.17 pound per ton of ore of a thioisobutyl ethyl butyl ether frother of the general structure:

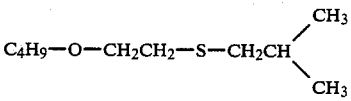

Test results are set forth in Table I below.

EXAMPLE 5

The Experimental Procedure set forth above is followed in every material detail on an ore sample ground to 2.4% +100 mesh and 60.2% −200 mesh and employing 0.17 pound per ton of ore of a thioisobutylmethyl(2-methyl)propionate frother of the general structure:

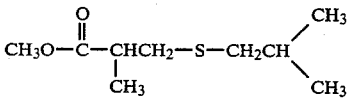

Test results are set forth in Table I below.

TABLE I

| Example | Frother | Frother Performance Evaluation: Frother Dosage lb/ton | Copper Grade | % Copper Recovery | Molybdenum Grade | % Molybdenum Recovery |
|---|---|---|---|---|---|---|
| Comp. A | polypropylene glycol | 0.17 | 7.47 | 84.12 | 0.293 | 86 |
| Comp. B | methylisobutyl carbinol | 0.17 | 11.01 | 82.15 | 0.360 | 64 |
| Comp. C | butoxy propanol | 0.17 | 8.79 | 82.18 | 0.306 | 72 |
| 1 | isobutyl cyanoethyl amine | 0.17 | 13.30 | 86.1 | 0.416 | 78 |
| 2 | isobutyl cyanoethyl sulfide | 0.17 | 14.34 | 93.36 | 0.559 | 98 |
| 3 | isobutyl cyanoethyl ether | 0.17 | 13.00 | 81.51 | 0.453 | 70 |
| 4 | thioisobutyl ethyl butyl ether | 0.17 | 9.27 | 82.52 | 0.333 | 76 |
| 5 | thioisobutyl methyl (2-methyl) propionate | 0.17 | 10.40 | 84.8 | 0.426 | 92 |

COMPARATIVE EXAMPLE D

The Experimental Procedure set forth above is followed on an ore sample ground to 2.4% +100 mesh and 60.2% −200 mesh and employing 0.17 pound per ton of ore of a methyl isobutyl carbinol frother of the general structure:

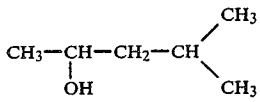

Test data and results are set forth in Table II below.

EXAMPLE 6

The Experimental Procedure set forth above is followed on an ore sample ground to 2.4% +100 mesh and 60.2% −200 mesh and employing 0.17 pound per ton of ore of an isobutyl cyanoethyl sulfide frother of Example 1 of the general structure:

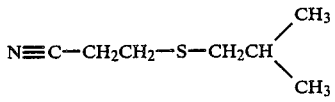

Test data and results are set forth in Table II below.

TABLE II

Assay: 0.52% Cu; 0.02% Mo
Collectors: None
Flotation pH: 9.0

| Example | Frother | Frother Dosage lb/ton | Assays % Cu | Assays % Mo | Recovery % Cu | Recovery % Mo |
|---|---|---|---|---|---|---|
| Comparative D 6 | methylisobutyl carbinol | 0.17 | 6.77 | 0.386 | 24.2 | 30.1 |
| | isobutyl cyanoethyl sulfide | 0.17 | 18.08 | 0.573 | 87.0 | 79.8 |

COMPARATIVE EXAMPLE E

The Experimental Procedure set forth above is followed on an ore sample ground to 10% +65 mesh and employing 0.06% pound per ton of ore of a commercial alcohol frother. Test data and results are set forth in Table III below.

EXAMPLE 7

The Experimental Procedure set forth above is followed on an ore sample ground to 10% +65 mesh and employing 0.069 pound per ton of ore of an isobutyl cyanoethyl sulfide frother of Example 1 of the general structure:

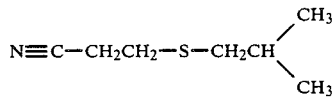

Test data and results are set forth in Table III below.

TABLE III

Assay: 0.98% Cu; 0.02% Mo
Collectors: 0.0102 lb/ton sodium disecbutyldithiophosphate
0.025 lb/ton potassium amylxanthate
0.0072 lb/ton diesel fuel
Flotation pH: 11.4

| Example | Frother | Frother Dosage lb/ton | Assays % Cu | Assays % Mo | Recovery % Cu | Recovery % Mo |
|---|---|---|---|---|---|---|
| Comparative E 7 | alcohol frother | 0.069 | 13.44 | 0.339 | 85.3 | 70.3 |
| | isobutyl cyanoethyl sulfide | 0.069 | 12.69 | 0.356 | 89.1 | 73.3 |

COMPARATIVE EXAMPLE F

The Experimental Procedure set forth above is followed on an ore sample ground to 33% +100 mesh and 45% −200 mesh and employing 0.06 pound per ton of ore of a methylisobutyl carbinol frother of the general structure:

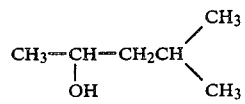

Test data and results are set forth in Table IV below.

EXAMPLE 8

The Experimental Procedure set forth above is followed on an ore sample ground to 33% +100 mesh and 45% −200 mesh and employing 0.06 pound per ton of ore of an isobutyl cyanoethyl sulfide frother of Example 1 of the general structure:

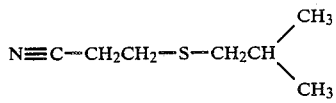

Test data and results are set forth in Table IV below.

TABLE IV

Assays: 0.34% Cu; 0.023% Mo
Collectors: 0.0075 lb/ton allylamylxanthate
0.005 lb/ton potassium amylxanthate
0.04 lb/ton fuel oil
Floation pH: 11.0

| Example | Frother | Frother Dosage lb/ton | Assays % Cu | Assays % Mo | Recovery % Cu | Recovery % Mo |
|---|---|---|---|---|---|---|
| Comparative F 8 | methylisobutyl carbinol | 0.06 | 9.07 | 0.533 | 93.4 | 87.7 |
| | isobutyl cyanoethyl sulfide | 0.06 | 9.25 | 0.655 | 94.1 | 91.1 |

COMPARATIVE EXAMPLE G

The Experimental Procedure set forth above is followed on an ore sample ground to 25% +65 mesh and employing 0.036 pound per ton of ore of a polypropylene glycol monomethyl frother. Test data and results are set forth in Table V below.

EXAMPLE 9

The Experimental Procedure set forth above is followed on an ore sample ground to 25% +65 mesh and employing 0.036 pound per ton of ore of a isobutyl cyanoethyl sulfide frother of Example 1 of the general structure:

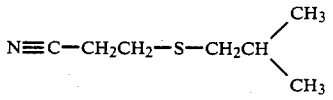

Test results are set forth in Table V below.

TABLE V

Assays: 0.5% Cu; 0.012% Mo
Collectors: 0.01 lb/ton allylamylxanthate
0.004 lb/ton sodium isopropylxanthate
0.01 lb/ton sodium diethyldithiophosphate
Flotation pH: 10.5

| Example | Frother | Frother Dosage lb/ton | Assays % Cu | Assays % Mo | Recovery % Cu | Recovery % Mo |
|---|---|---|---|---|---|---|
| Comparative 6 | polypropylene glycol monomethyl | 0.036 | 6.90 | 0.098 | 85.3 | 58.3 |
| 9 | isobutyl cyanoethyl sulfide | 0.036 | 7.10 | 0.109 | 84.4 | 64.3 |

EXAMPLE 10

When the procedure of Example 3 is followed in every material detail except that the mineral value collected is coal, substantially equivalent results are obtained.

EXAMPLE 11

When the Experimental Procedure is followed in every material detail employing a frother of the general formula:

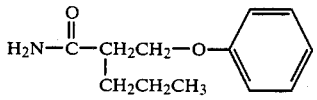

substantially equivalent results are obtained.

EXAMPLE 12

When the Experimental Procedure is followed in every material detail employing a frother of the general formula:

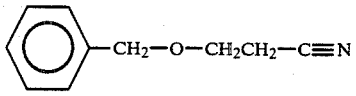

substantially equivalent results are obtained.

We claim:

1. A process for collecting mineral values from an ore wherein said process comprises mixing ground ore with water to form an aqueous ore pulp, adding to said aqueous ore pulp an effective amount of a frother, aerating said aqueous ore pulp and thereafter recovering said mineral values, wherein the frother is of the general structure:

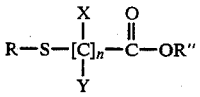

wherein R is taken from the group consisting of a saturated aliphatic radical of 1 to 12 carbon atoms, inclusive; a phenyl and an alkylaryl wherein the allyl group consists of a saturated aliphatic radical of 1 to 6 carbon atoms, inclusive; n is an integer of 1 to 4, inclusive; x and y are individually either hydrogen or a saturated aliphatic radical of 1 to 8 carbon atoms, inclusive; and R" is an aliphatic radical having 1 to 8 carbon atoms, inclusive.

2. The process of claim 1 wherein an effective amount is from about 0.01 pound of frother per ton of ore to about 1.0 pound of frother per ton of ore.

3. The process of claim 1 wherein the ore is sulfide ore.

4. The process of claim 3 wherein the sulfide ore is copper-molybdenum.

* * * * *